United States Patent [19]

Gillis

[11] 3,986,519

[45] Oct. 19, 1976

[54] EXTERNAL FLEXED STRUCTURE WITH PIVOTABLE FITTING FOR AN INTERNAL MEMBRANE

[76] Inventor: Robert E. Gillis, P.O. Box 67, Aptos, Calif. 95003

[22] Filed: Sept. 18, 1975

[21] Appl. No.: 614,445

[52] U.S. Cl. ..... 135/3 E; 24/73 PF; 24/DIG. 17; 135/15 CF

[51] Int. Cl.[2] ..... A45F 1/16

[58] Field of Search ..... 135/4 R, 3 E, 15 CF; 24/73 P, 73 PF, 90 PR, DIG. 17, 208 A, 245 L, 245 R, 107, 108; 248/317, 342, 343

[56] References Cited

UNITED STATES PATENTS

| | | | |
|---|---|---|---|
| 1,880,845 | 10/1932 | Czop | 24/DIG. 17 |
| 2,364,266 | 12/1944 | Bryce | 24/DIG. 17 |
| 2,548,004 | 4/1951 | Duefrene | 24/DIG. 17 |
| 3,863,659 | 2/1975 | Gillis | 135/3 E |

*Primary Examiner*—Werner H. Schroeder
*Assistant Examiner*—Conrad L. Berman
*Attorney, Agent, or Firm*—Sughrue, Rothwell, Mion, Zinn and Macpeak

[57] ABSTRACT

A flexible structure is composed of a plurality of pole or rod elements including at least two series of rows of such rods, the rods of each row being substantially parallel to one another. The rows are intersecting, but are uniform in respective orientation. The rods are stabilized at the intersections by fittings which permit relative sliding movement of restricted degree. These fittings are secured to a flexible membrane or body portion.

A swivel relation exists between the fittings and related components.

Modification of the fittings to provide multiple layer body portions is achieved through the application of spaced layers of material.

8 Claims, 8 Drawing Figures

FIG. 1
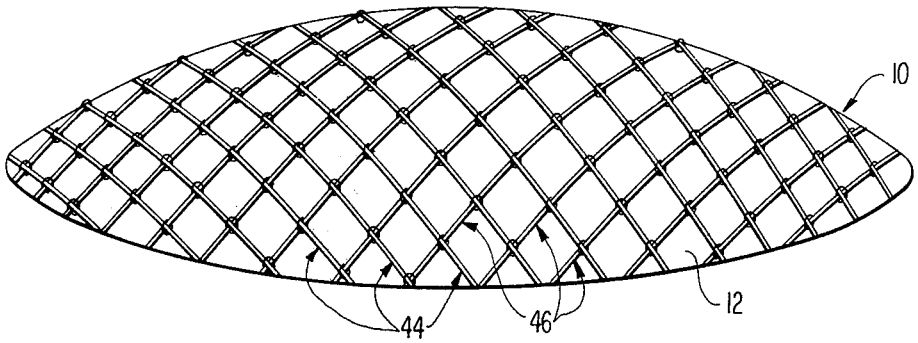
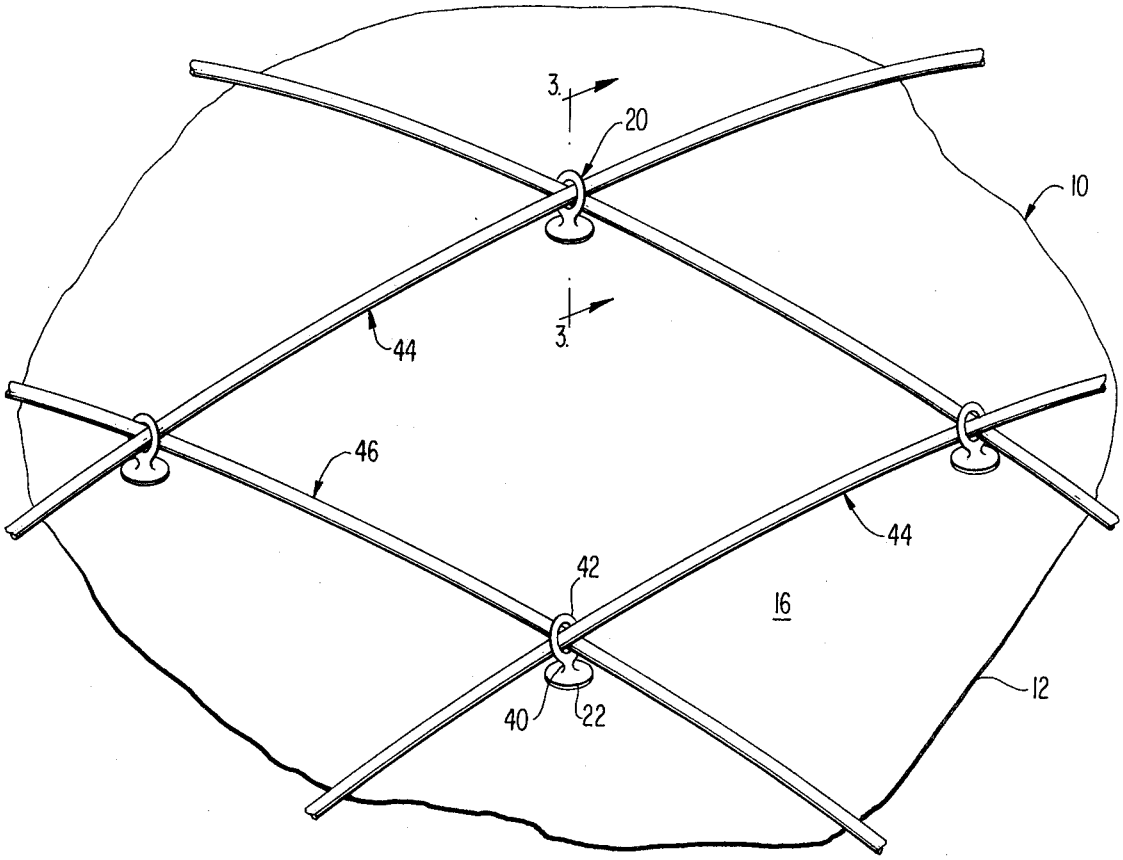
FIG. 2

FIG. 3
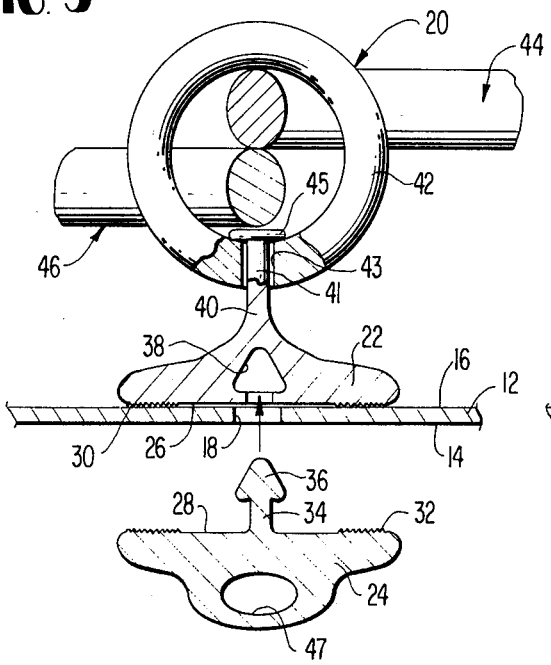
FIG. 4
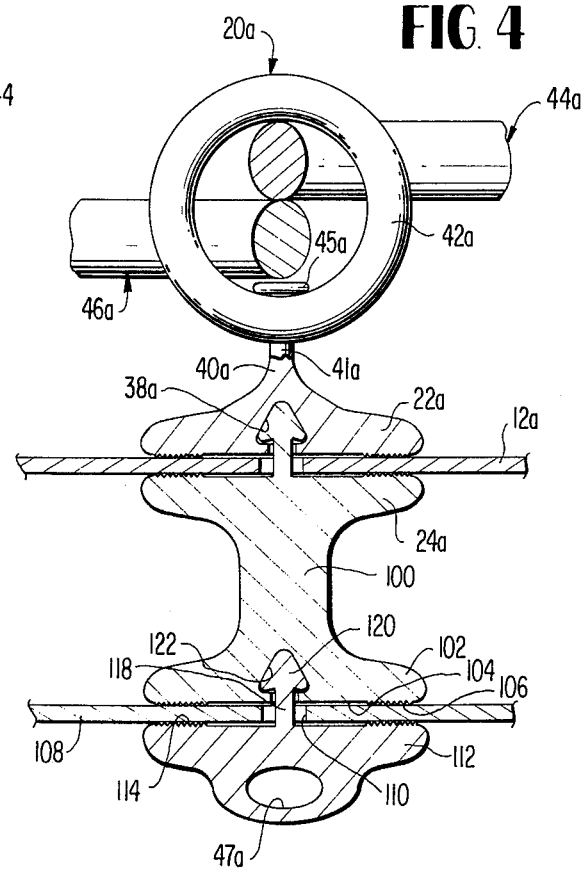
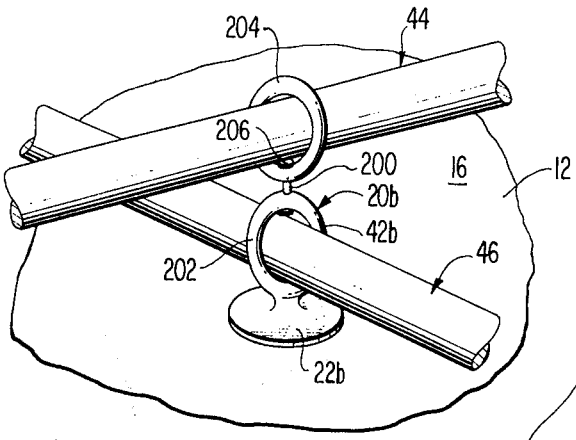
FIG. 5
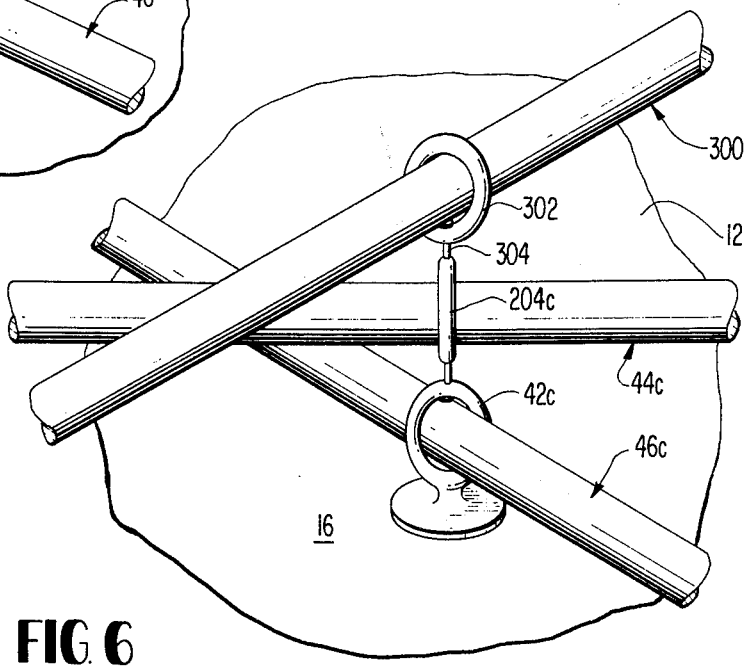
FIG. 6

EXTERNAL FLEXED STRUCTURE WITH PIVOTABLE FITTING FOR AN INTERNAL MEMBRANE

BACKGROUND OF THE INVENTION

1. Field of the Invention

This invention relates to a flexible structure having a broad range of utility. Illustratively, the structure may be embodied in a tent or enclosure, a kite, a boat, or other environments wherein a flexible body is employed.

2. Statement of the Prior Art

This invention is to some extent an extension or improvement on the subject matter shown in my prior U.S. Pat. No. 3,863,659. Other pertinent prior patents known to me include the following:

| Patent No. | Patentee | Issue Date |
|---|---|---|
| 2,914,074 | Fuller | March 1, 1957 |
| 3,006,670 | Schmidt | Oct. 31, 1961 |
| 3,269,398 | Holbitz | Aug. 30, 1966 |
| 3,710,806 | Kelly et al | Jan. 16, 1973 |
| 3,744,191 | Bird | July 10, 1973 |
| 3,838,703 | Zeigler | Oct. 1, 1974. |

SUMMARY OF THE INVENTION

The present invention provides a flexible structure of unlimited utility and features a flexible membrane or body portion having a series of rods or poles arranged in intersecting rows. These are stabilized at intersection points by fittings which permit slidable movement. Such sliding movement may be effected in several manners, but preferably is through the use simply of an annular element of sufficient dimension to accommodate the poles in sliding fashion.

The structure provided hereby is characterized by a substantial strength to weight ratio in relation to its enclosed volume. This is believed to result from a synergetic inter-action between the outwardly stressed poles or rods, and the annular elements secured to the membrane. The slidable nature of the association of these components, with the annular elements attached to the membrane, permits the formation of multi-faceted, complex structures with ease and speed. Such structures are easily disassembled as well.

In principal embodiments of the invention, a swivel relationship exists between the annular elements and related components permitting self-adjustment of the components.

Other and further objects and advantages of the invention will become apparent to those skilled in the art from a consideration of the following specification when read in conjunction with the annexed drawings.

BRIEF DESCRIPTION OF THE DRAWINGS

FIG. 1 is a perspective view of a dome-like structure formed in accordance with the present invention;

FIG. 2 is an enlarged fragmentary view of the structure;

FIG. 3 is a further enlarged sectional view taken substantially on line 3—3 of FIG. 2, looking in the direction of the arrows;

FIG. 4 is a view similar to FIG. 3 showing a modification employed in forming a multi-layer structure;

FIG. 5 is another fragmentary top perspective view showing a first modified form of intersection;

FIG. 6 shows another type of crossover;

DESCRIPTION OF THE PREFERRED EMBODIMENTS

Figure 7:
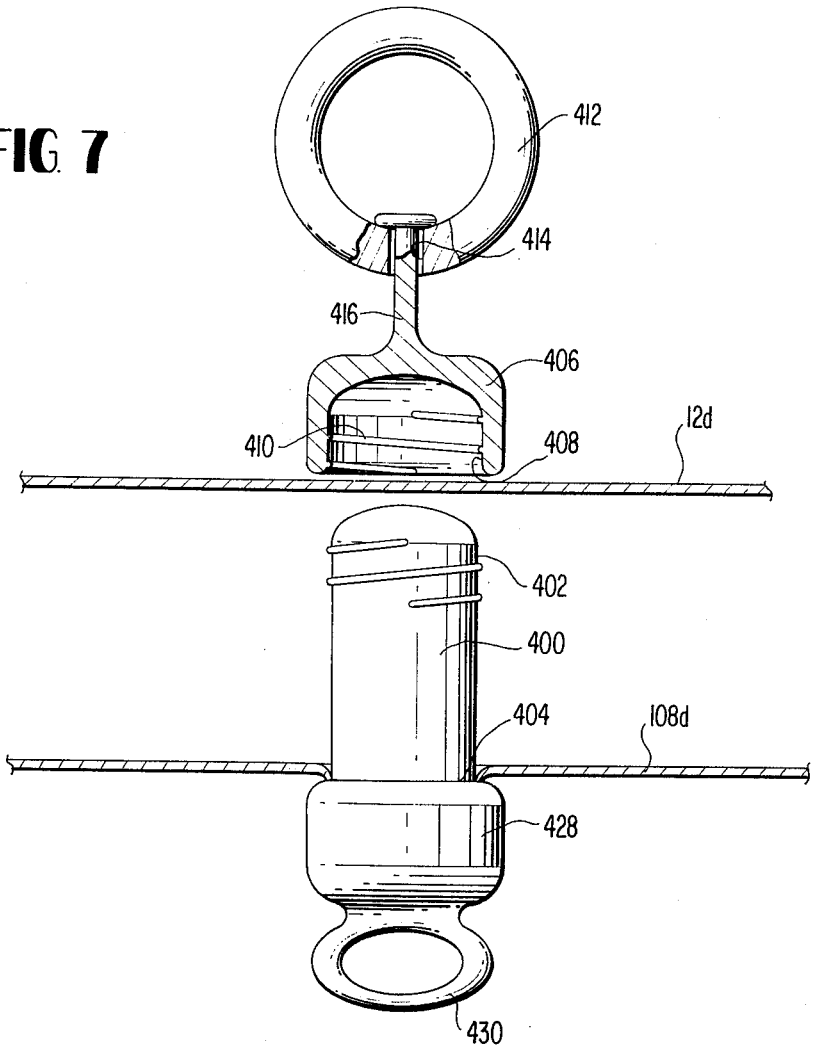
FIG. 7 discloses another modification.

The dome shown in FIG. 1 and identified by reference character 10 is representative of the forms in which the structure hereof may be embodied. The tent-like form is of a broad range of utility as an enclosure. Other environments of employment of the structure are set forth hereinabove.

A basic component of the structure is a flexible membrane or sheath 12 having an inner surface 14 and an outer surface 16. The membrane is formed of plastic or other material and has the characteristic of being stretchable in multiple, directions. Throughout its extent the membrane has connection locations such as apertures 18 formed therein, said apertures being arranged in rows.

FIGS. 2 and 3 disclose a first basic form of fitting assembly 20 hereof. A fitting assembly 20 is provided for each of the apertures. The assemblies 20 each comprises an outer base 22 and an inner base 24. The bases have inside walls 26, 28, respectively, provided about their outer circumferences with projecting teeth 30 and 32. These teeth grip the material of the membrane to insure a tightly sealed relation beween the fitting and the membrane. The fitting assembly further includes means extending through the aperture to clampingly secure the fitting to the membrane. In FIG. 3, such means is shown as comprising a shaft 34 extending vertically from the inner base 24. The shaft has an enlarged, tapered plug 36 on its outer end. Formed in the outer base 22 is a chamber 38 shaped to correspond to the configuration of the shaft 34 and plug 36. The fitting is of rubber or a similar material, and thus, the plug is engageable in the chamber. The plug and shaft are extended through the aperture and into engagement in the chamber, thus locking the bases on opposite sides of the membrane.

Extending vertically from the outer base 22 is a vertical stem 40. The stem is provided with a swivel pin 41. The swivel pin 41 is seated in a bore in an enlarged annular ring member 42 mounted on the stemm 40. The swivel pin has a top plate 45 which permits disassembly. The ring member is rotatable to permit variance in orientation, for accommodation of the intersecting rods at various angles.

The base 24 is formed with an interior hole 47 from which items may be suspended.

The invention has, as an important structural feature thereof, two or more intersecting series of support rods which coact with the membrane 12 and fittings 20 to form the structure hereof. This includes a first series of rods 44 which extend substantially parallel to one another, and a second series of rods 46, also mutually generally parallel. The rods of each series are constructed of material, such as a solid or tubular resinous, or metallic substance, which is rigid and yet permits flexation. The rods are flexed in arch form during assembly and are of varying lengths depending upon location.

The rods are positioned along the rows of apertures, and extend in sliding relation through the ring members 42 of the fittings. The rods of the second series 46 intersect those of the first series and pass under those of the first series, there being a relatively loose fit through the ring members 42. The rods are stabilized by the omnidirectional tension of the membrane.

FIG. 4 shows a modified form of fitting, components corresponding to those in the first described form being identified by like reference characters with a letter *a* appended thereto. The fittings 20*a* have an outer base 22*a* which is snap fit to an inner base 24*a*. Depending integrally from the inner base is a spacer extension 100 having a disc member 102 thereon. The disc member 102 has a flat lower face 104 with teeth 106 and contacts an inner membrane layer 108 about an aperture 110 therein. The apertures 110 in the inner membrane layer are vertically aligned with the apertures of the outer layer. The disc member 102 is secured to the inner membrane layer 108 by a lower disc 112 having an inside face 114 with teeth 116, and having a prong 118 with an enlarged head 120 — a suspension hole 47*a* being provided therein. The prong and head extend through the aperture 110 and seat in a correspondingly shaped socket 122 formed in the disc 102. The second form of the invention therefore provides for two layers of membrane, for insulation or added strength.

In FIG. 5, still another modification is shown. Here, the intersection of the rods from the first and second series thereof is accomplished with a fitting 20*b* similar to the fitting 20. The ring member 42*b* is of reduced diameter however, and will accommodate only a single rod. A swivel pin 200 is extended through an opening formed in the top of the ring member, and has an enlarged end 202 to prevent withdrawal. A second ring member 204 has an opening in its lower end, and the pin extends therethrough again having an enlarged end 206. This constitutes another means to permit limited relative sliding movements of the rods at their intersection points.

In some configurations of a more complex nature than the basic concave-convex form shown in FIG. 1, additional series of rods may be required. FIG. 6 illustrates an embodiment wherein three intersecting series of rods 44*c*, 46*c* and 300 are employed. There a third ring member 302 is added above the ring members 204*c* and 42*c*. This is accomplished through a swivel pin 304 identical to the pin 200 described above. This arrangement may be further modified by adding rings to provide for any number of tiers of rods.

FIG. 7 shows yet another form in which the membrane 12*d* is imperforate. Fittings 20*d* comprise a central body 400 having shallow outwardly threaded end portions 402 and 404. An upper body 406 has a socket 408 with threads 410 interfitting with the end portion 402. A ring member 412 has an aperture 414 therein in which a stem 416 of the upper body is pivotally mounted. The ring is not detachable but is pivotal relative to the body 406. A lower body 428 is formed with a threaded socket (not specifically shown) and has a depending oval ring 430. This central body 400 engages the imperforate outer membrane 12*d* and clampingly engages it in the socket 408 between the loosely fitting screw threads, while the lower body socket is clamped to the inner membrane 108*d* in similar fashion. The connection is established at connection locations which are suitably determined on the respective membranes.

Figure 8:
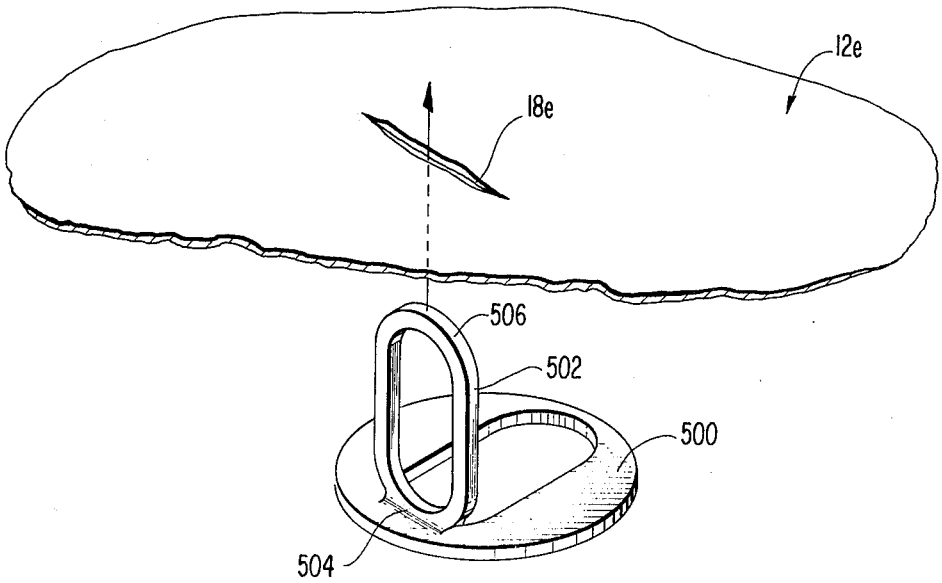
FIG. 8 shows still another form of intersection.

Finally, in FIG. 8, a non-complex form of fitting 20*e* is used wherein the member 12*e* is formed with slits 18*e* comprising the connection locations. The fittings comprise discoidal bases 500 having a punched or struck tab 502. The tab includes a stem section 504 bent to substantially perpendicular relation to the base and having an elongated ring member 506. The tabs extend through the slits 18*e* to receive the appropriate poles.

I claim:

1. A flexible structure comprising:

a flexible membrane having an inner surface and an outer surface;

the membrane having a series of connection locations arranged therein in rows;

a fitting assembly for each of said connection locations, the fitting assemblies each comprising an outer base and an inner base, securing means extending between said bases and extending through the connection locations to clampingly engage the bases, respectively, against the outer and inner surfaces of the membrane, a stem extending from the outer base, and an enlarged annular ring pivotally mounted element on said stem;

a first series of substantially parallel outwardly stressed rods, the rods extending in arch form through the annular ring elements of the fittings aligned therewith, said rods being stressed in said arch form;

a second series of substantially parallel outwardly stressed rods, the rods extending in arch form through the annular ring elements of the fittings aligned therewith, said rods being stressed in said arch form; and the rods of said first and second series intersecting one another at said ring elements and said connection locations being common to the respective series to provide an interlocking structure, said rods being located external of said membrane.

2. The invention of claim 1, wherein:

the connection locations comprise apertures formed in the membrane.

3. The invention of claim 2, wherein:

the inner and outer bases of the fitting assemblies have teeth thereon said teeth being located on opposing, adjacent surfaces.

4. The invention of claim 2, wherein:

the outer bases have chambers formed therein; and the inner bases have plugs which extend through the apertures and engage in said chambers to lock said bases to one another on opposite sides of the membrane.

5. The invention of claim 2, and:

an inner membrane layer having apertures formed therein in alignment with the apertures of the flexible membrane;

the lower bases of the fittings having spacer extensions thereon with first spaced disc members;

the disc members having a socket formed therein; and a second lower disc member having a prong extended through the aperture of the inner membrane layer and engaged in the socket of the second disc member.

6. The invention of claim 2, wherein:

the fittings include a plurality of ring members; and the ring members of each fitting are secured together by pins.

7. The invention of claim 6, and:

a third series of rods; and the fittings each including three ring members, the third series of rods intersecting the first and second series of rods at said fittings.

8. A flexible structure comprising:

a flexible outer membrane having an inner surface and an outer surface and a flexible inner membrane;

the outer and inner membrane each having a series of connection locations therein arranged in rows;

a fitting assembly for each of said connection locations, the fitting assemblies each comprising a central body having threaded end portions, an upper body and a lower body, said upper and lower bodies having threaded sockets therein, and the upper bodies having enlarged annular ring elements thereon;

a first series of substantially parallel rods, the rods extending in arch form through the annular ring elements of the fittings aligned therewith; said rods being stressed in said arch form;

a second series of substantially parallel rods, the rods extending in arch form through the annular ring elements of the fittings aligned therewith, said rods being stressed in said arch forms;

the rods of said first and second series extending and being in intersecting relationship through the annular ring elements; and said ring and rod elements being external of said membrane.

* * * * *